US012709437B1

(12) United States Patent
Jiang

(10) Patent No.: US 12,709,437 B1
(45) Date of Patent: Aug. 18, 2026

(54) STACKABLE AND SLIDABLE BOX AND BOX ASSEMBLY

(71) Applicant: Shaomian Jiang, Puning (CN)

(72) Inventor: Shaomian Jiang, Puning (CN)

( * ) Notice: Subject to any disclaimer, the term of this patent is extended or adjusted under 35 U.S.C. 154(b) by 0 days.

(21) Appl. No.: 19/442,999

(22) Filed: Jan. 7, 2026

(51) Int. Cl.
*B65D 21/02* (2006.01)

(52) U.S. Cl.
CPC ..... *B65D 21/0213* (2013.01)

(58) Field of Classification Search
CPC ..... B65D 21/0213
USPC ..... 206/509
See application file for complete search history.

(56) References Cited

U.S. PATENT DOCUMENTS

| | | | | |
|---|---|---|---|---|
| 4,971,202 | A * | 11/1990 | Box | B65F 1/0053 206/429 |
| 7,556,165 | B2 | 7/2009 | McDade | |
| 7,699,172 | B2 * | 4/2010 | McTavish | B65D 21/0213 206/509 |
| 11,352,168 | B2 | 6/2022 | Green et al. | |
| 11,731,803 | B2 | 8/2023 | Green | |
| 11,807,414 | B2 | 11/2023 | Green et al. | |
| 12,103,576 | B2 | 10/2024 | Elden | |
| 2007/0158347 | A1 * | 7/2007 | Ohayon | B65D 1/22 220/23.6 |
| 2011/0114528 | A1 * | 5/2011 | Hirz | B65D 21/0213 206/509 |
| 2018/0273245 | A1 * | 9/2018 | Sommer | B65D 21/0212 |

FOREIGN PATENT DOCUMENTS

| | | | | |
|---|---|---|---|---|
| CA | 3031637 | C | 3/2022 | |
| DE | 10048825 | A1 * | 4/2002 | B65D 21/0213 |
| EP | 2520507 | B1 | 2/2016 | |
| EP | 2673205 | B1 | 5/2017 | |

* cited by examiner

*Primary Examiner* — Jacob K Ackun
(74) *Attorney, Agent, or Firm* — Bayramoglu Law Offices LLC

(57) ABSTRACT

A stackable and slidable box includes a bottom plate and a side plate assembly, where a connecting protrusion is continuously formed along an edge of the bottom plate; paired guide grooves are formed in a bottom of the connecting protrusion; the paired guide grooves are respectively located on two opposite sides of the bottom plate; the side plate assembly includes a first connecting plate and a pair of parallel side plates; two sides of the first connecting plate are respectively connected to the side plates; bottoms of the side plates and a bottom of the first connecting plate are inserted into a top of the connecting protrusion; a guide protrusion is convexly form on a top of each of the side plates; and the guide protrusion is located at a same side as the guide groove.

17 Claims, 7 Drawing Sheets

STACKABLE AND SLIDABLE BOX AND BOX ASSEMBLY

TECHNICAL FIELD

The present disclosure relates to the technical field of storage boxes, and in particular to a stackable and slidable box and a box assembly.

BACKGROUND

As commonly used storage tools in daily life and work, storage boxes have been widely used to organize and store various items. For ease of transportation, most existing storage boxes are designed to be collapsible, but the strength of the sidewalls of these boxes in use is not sufficiently high. When a plurality of boxes are stacked for use, they cannot be loaded with excessively heavy items. Furthermore, the stacked boxes cannot slide relative to each other, causing inconvenience when removing the items from the boxes.

SUMMARY

(I) Technical Problem to be Solved

The present disclosure provides a stackable and slidable box and a box assembly, to solve the technical problem of inconvenience when a plurality of boxes are stacked for use in the prior art.

(II) Technical Solutions

To solve the above problem, the present disclosure provides a stackable and slidable box, including a bottom plate and a side plate assembly, where a connecting protrusion is continuously formed along an edge of the bottom plate; paired guide grooves are formed in a bottom of the connecting protrusion; and the paired guide grooves are respectively located on two opposite sides of the bottom plate; and the side plate assembly includes a first connecting plate and a pair of parallel side plates; the first connecting plate is located on one side of each of the side plates; two sides of the first connecting plate are respectively connected to the side plates; bottoms of the side plates and a bottom of the first connecting plate are inserted into a top of the connecting protrusion; a guide protrusion is convexly disposed on a top of each side plate; and the guide protrusion is located at a same side as the guide groove.

Preferably, an outer side of the guide protrusion is provided with an anti-disengagement groove; a length direction of the anti-disengagement groove is the same as a length direction of the guide protrusion; an anti-disengagement protrusion protruding toward an interior of the guide groove is disposed on a sidewall of the guide groove; and the anti-disengagement protrusion corresponds to the anti-disengagement groove.

Preferably, the bottom plate is a rectangular plate.

Preferably, a first insertion opening is formed along a vertical direction in the connecting protrusion; and a first insertion strip is convexly disposed on the bottom of the side plate;

two opposite sidewalls of the first insertion opening are each provided with a gap;

two opposite sides of the first insertion strip are each provided with a clamping member; the clamping member includes a first inclined guide surface and a first abutment plane that are sequentially connected; and when the first insertion strip is inserted into the first insertion opening, the clamping member is located in the gap, and the first abutment plane of the clamping member abuts against a top of the gap.

Preferably, a second insertion opening is further formed along the vertical direction in the connecting protrusion; and a second insertion strip is convexly disposed on the bottom of the first connecting plate;

a first stop is convexly disposed in the second insertion opening; and an upper side of the first stop is an inclined surface; and an end of the second insertion strip includes a second inclined guide surface and a second abutment plane that are sequentially connected; the second inclined guide surface has a same inclination direction as the upper side of the first stop; and when the second insertion strip is inserted into the second insertion opening, the second abutment plane abuts against a bottom of the first stop.

Preferably, the side plate assembly further includes a second connecting plate; the second connecting plate is located on another side of each of the side plates; the second connecting plate is configured to connect the two side plates; and the bottom of the first connecting plate is provided with a T-shaped groove and a stop groove;

a first T-shaped guide rail and a second stop are disposed on a sidewall of the connecting protrusion; a side of the second stop is an inclined surface; and a bottom of the second stop is a plane; and when the second connecting plate is mounted on the connecting protrusion, the T-shaped groove is sleeved on the first T-shaped guide rail, and the bottom of the second stop abuts against a sidewall of the stop groove.

Preferably, two opposite sides of the side plates are each provided with a second T-shaped guide rail; the second T-shaped guide rail includes a connecting strip and a snap-fit strip; one side of the connecting strip is connected to the side plate; another side of the connecting strip is connected to a middle of the snap-fit strip; and the connecting strip is perpendicular to the snap-fit strip;

two opposite sides of the first connecting plate and the second connecting plate are each provided with an elongated hole in a penetration manner; and the second T-shaped guide rail is slidably disposed in the elongated hole; the connecting strip penetrates through the elongated hole; and a width of the snap-fit strip is greater than a width of the elongated hole.

Preferably, an opening is formed in the second connecting plate in a penetration manner.

Preferably, a height of the first connecting plate is less than a height of each of the side plates.

The present disclosure further provides a box assembly, where the box assembly includes a plurality of boxes as described above; and the plurality of boxes are sequentially stacked; and in two adjacent ones of the plurality of boxes, the guide protrusion of a first box is slidably disposed in the guide groove of a second box; and the anti-disengagement protrusion of the second box is located in the anti-disengagement groove of the first box.

(III) Beneficial Effects

According to the present disclosure, when a plurality of boxes are stacked together for use, in two adjacent boxes, the guide protrusion of the first box is slidably disposed in the guide groove of the second box, and two boxes can slide relative to each other, such that an item in the box is taken out conveniently in use. Since the guide protrusion and the guide groove are respectively located on the top and the bottom of the side plate, when the plurality of boxes are stacked for use, a weight of the item in the box is supported by the side plate. Moreover, since the side plate is non-collapsible, a load-bearing capacity of the box is improved, and the box can still be stacked for use after being loaded with a heavy item.

REFERENCE NUMERALS

Figure 1:
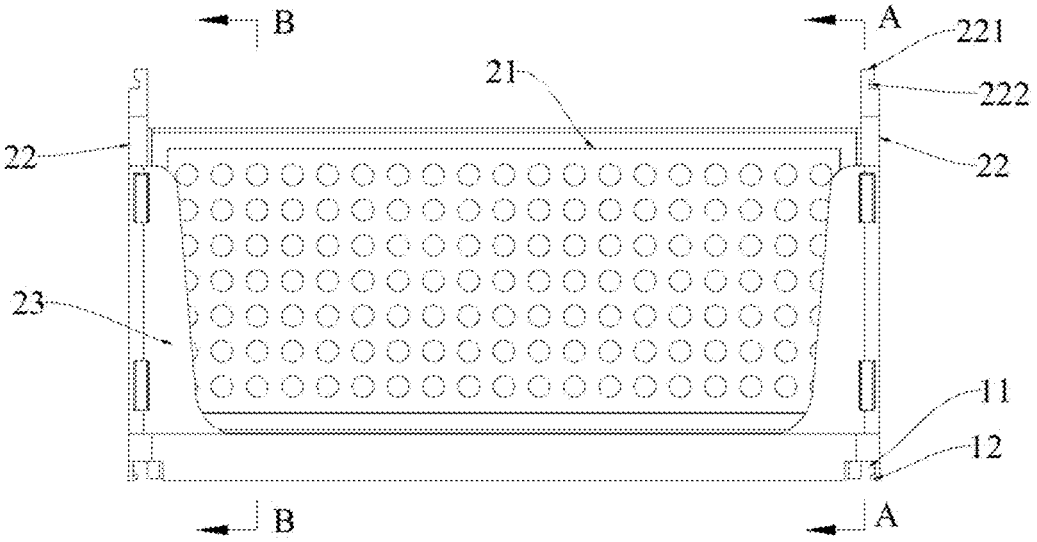
FIG. 1 is a front view of a box according to the present disclosure.
Figure 2:
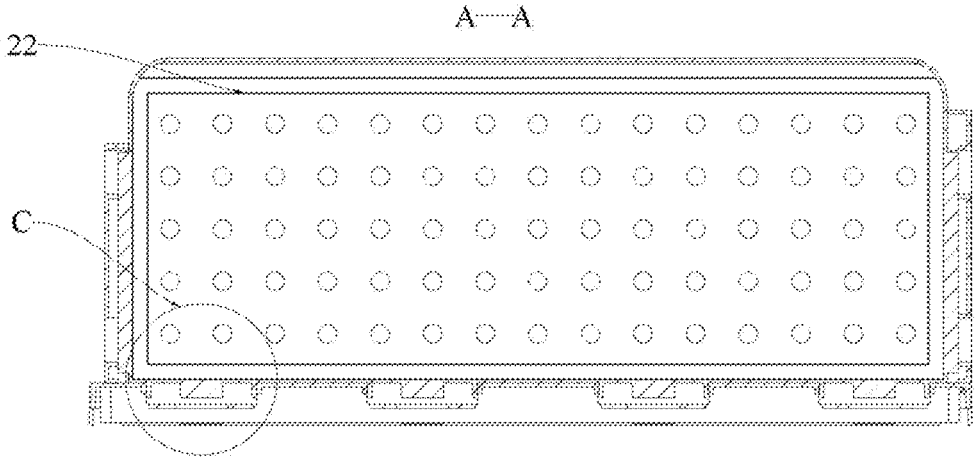
FIG. 2 is a sectional view along A-A shown in FIG. 1.
Figure 3:
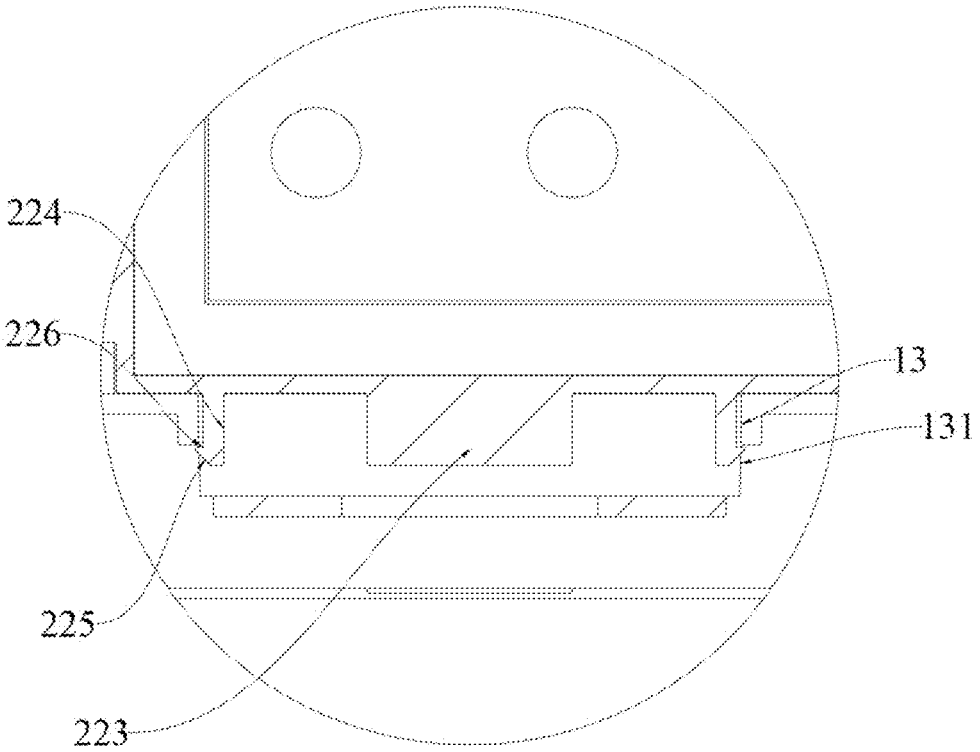
FIG. 3 is an enlarged view of C shown in FIG. 2.
Figure 4:
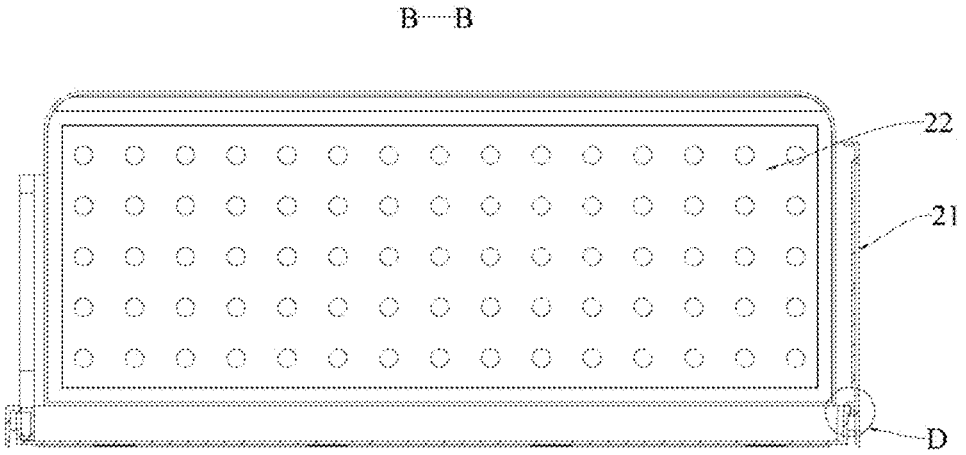
FIG. 4 is a sectional view along B-B shown in FIG. 1.
Figure 5:
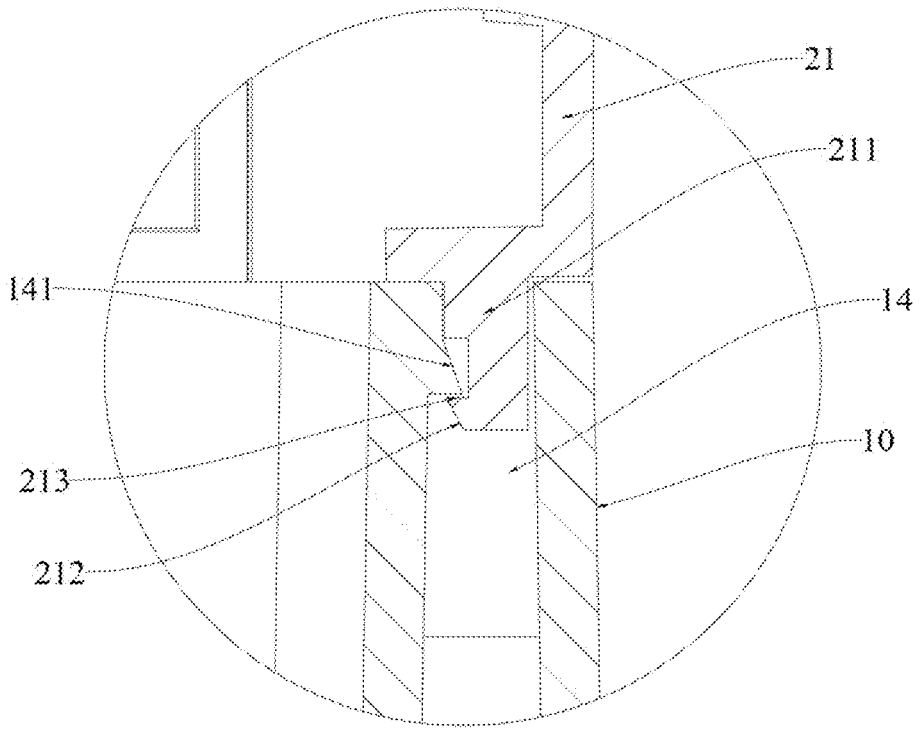
FIG. 5 is an enlarged view of D shown in FIG. 4.
Figure 6:
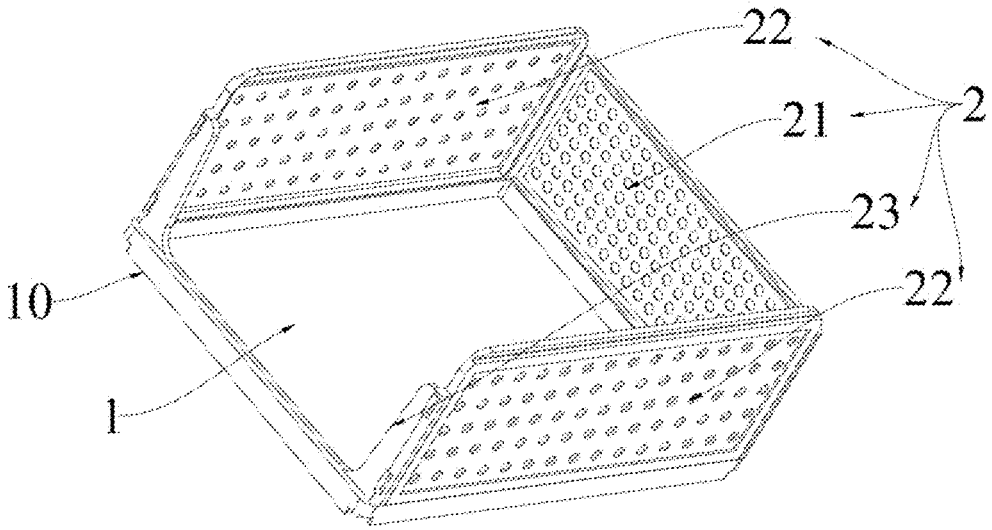
FIG. 6 is a stereoscopic view of a box according to the present disclosure.
Figure 7:
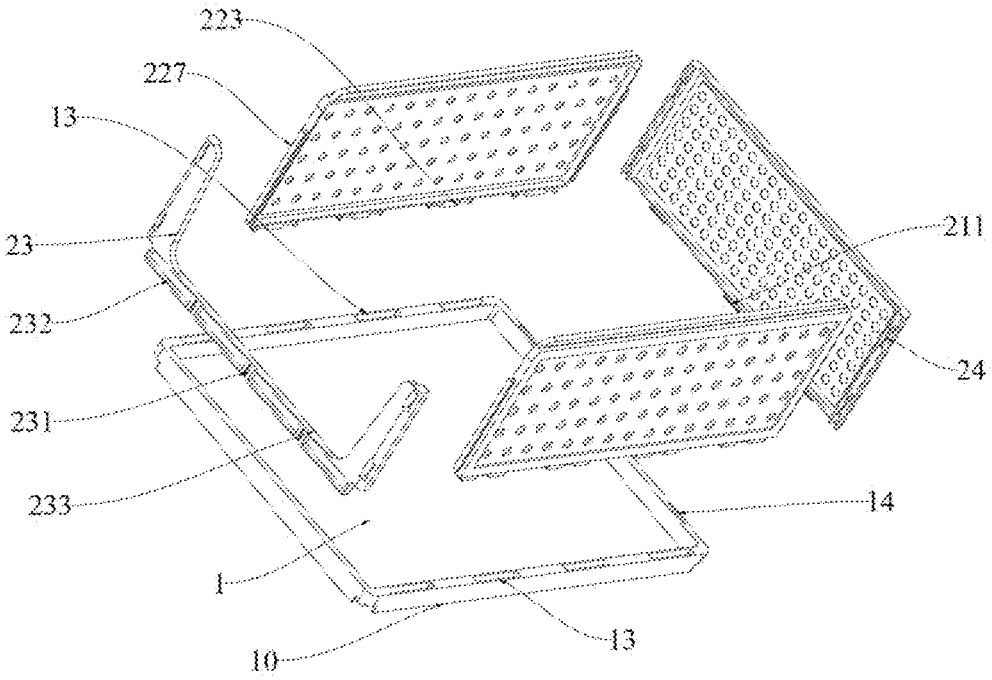
FIG. 7 is an exploded view of a box according to the present disclosure.
Figure 8:
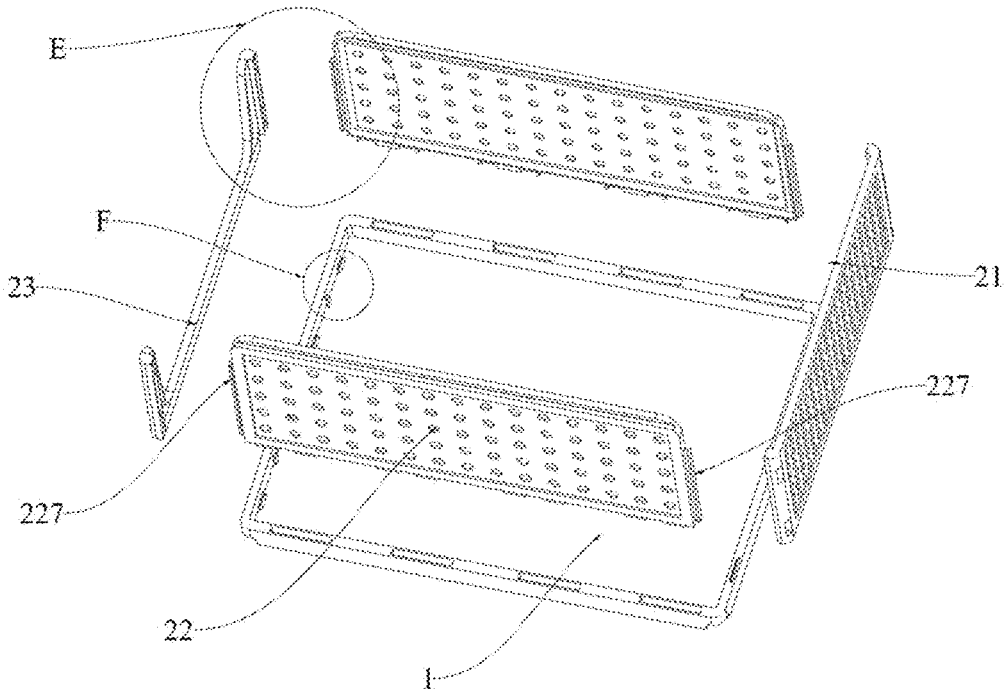
FIG. 8 is an exploded view of a box from another viewing angle according to the present disclosure.
Figure 9:
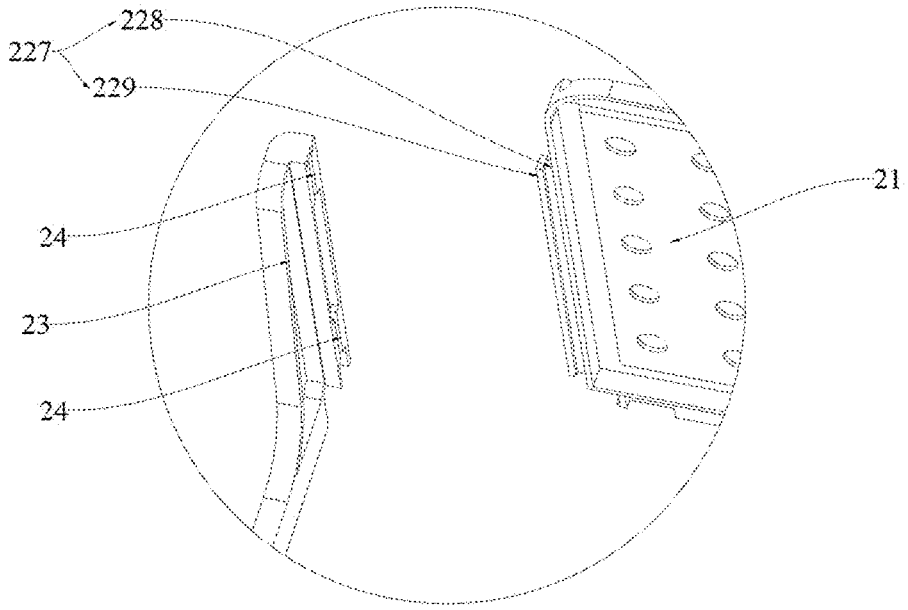
FIG. 9 is an enlarged view of E shown in FIG. 8.
Figure 10:
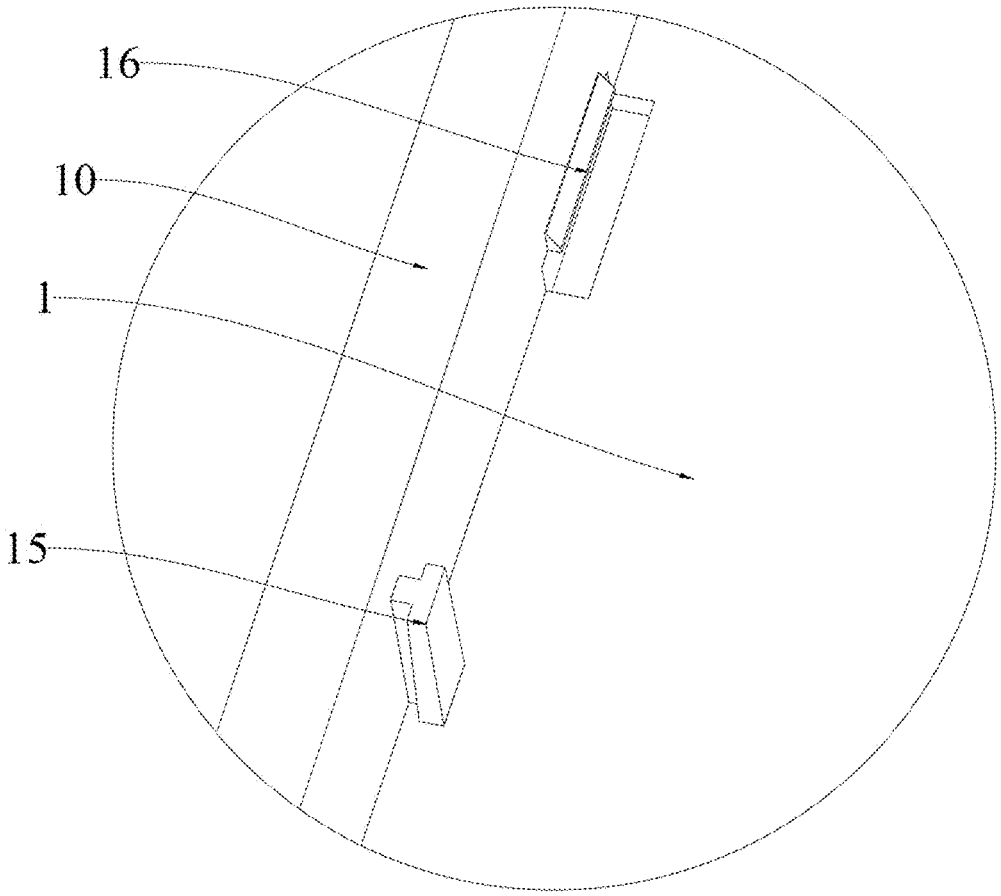
FIG. 10 is an enlarged view of F shown in FIG. 8.

1: bottom plate, 10: connecting protrusion, 11: guide groove, 12: anti-disengagement protrusion, 13: first insertion opening, 131: gap, 14: second insertion opening, 141: first stop, 15: first T-shaped guide rail, and 16: second stop; and

2: side plate assembly, 21: first connecting plate, 211: second insertion strip, 212: second inclined guide surface, 213: second abutment plane, 22: side plate, 221: guide protrusion, 222: anti-disengagement groove, 223: first insertion strip, 224: clamping member, 225: first inclined guide surface, 226: first abutment plane, 227: second T-shaped guide rail, 228: connecting strip, 229: snap-fit strip, 23: second connecting plate, 231: T-shaped groove, 232: stop groove, 233: opening, and 24: elongated hole.

DETAILED DESCRIPTION OF THE EMBODIMENTS

To facilitate a better understanding of the present disclosure, the present disclosure is described in detail below with reference to the accompanying drawings and specific implementations.

It should be noted that all the directional indications (such as upper, lower, left, right, front, and rear) in the embodiments of the present disclosure are merely used to explain relative position relationships, motion situations, and the like of the components in a specific gesture (as shown in the figures). If the specific gesture changes, the directional indication also changes accordingly.

Moreover, in the present disclosure, descriptions related to the terms such as "first" and "second" are only for the purpose of description and cannot be understood as indicating or implying relative importance, or implicitly indicating the number of the indicated technical features. Therefore, features defined by "first" and "second" may explicitly or implicitly include at least one of the features. In the descriptions about the present disclosure, "a plurality of" means at least two, for example, two or three, unless otherwise specifically limited.

In the present disclosure, unless otherwise clearly specified and limited, meanings of terms "connected", "fixed", and the like should be understood in a broad sense. For example, "connection" may be a fixed connection, a removable connection, or integration; may be a mechanical connection or an electrical connection; may be a direct connection or an indirect connection implemented by using an intermediate medium; or may be intercommunication between two components or an interaction relationship between two components, unless otherwise clearly limited. Those of ordinary skill in the art may understand specific meanings of the above terms in the present disclosure based on a specific situation.

The present disclosure provides a stackable and slidable box, including bottom plate 1 and side plate assembly 2. Connecting protrusion 10 is continuously formed along an edge of the bottom plate 1. Paired guide grooves 11 are formed in a bottom of the connecting protrusion 10. The paired guide grooves 11 are respectively located on two opposite sides of the bottom plate 1. The side plate assembly 2 includes first connecting plate 21 and a pair of parallel side plates 22. The first connecting plate 21 is located on one side of each of the side plates 22. The first connecting plate 21 is configured to connect the two side plates 22. Bottoms of the side plates 22 and a bottom of the first connecting plate 21 are inserted into a top of the connecting protrusion 10. Guide protrusion 221 is convexly disposed on a top of each side plate 22. The guide protrusion 221 is located at a same side as the guide groove 11.

In the technical solution of the present disclosure, the connecting protrusion 10 is continuously formed along the edge of the bottom plate 1, the bottom of the connecting protrusion 10 is provided with the guide groove 11, the top of the connecting protrusion 10 is configured to connect the side plate 22 and the first connecting plate 21 in the side plate assembly 2, and the guide protrusion 221 is disposed on the side plate 22. When a plurality of boxes are stacked together for use, in two adjacent boxes, the guide protrusion 221 of the first box is slidably disposed in the guide groove 11 of the second box, and two boxes can slide relative to each other, such that an item in the box is taken out conveniently. In addition, since the first connecting plate 21 is disposed on one side of the side plate 22, the item in the box can be taken out from another side of the side plate 22. Since the guide protrusion 221 and the guide groove 11 are respectively located on the top and the bottom of the side plate 22, when the plurality of boxes are stacked together for use, a weight of the item in the box is supported by the side plate 22. Moreover, since the side plate 22 is non-collapsible, a load-bearing capacity of the box is improved, and the box can still be stacked for use after being loaded with a heavy item.

Further, an outer side of the guide protrusion 221 is provided with anti-disengagement groove 222. A length direction of the anti-disengagement groove 222 is the same as a length direction of the guide protrusion 221. Anti-disengagement protrusion 12 protruding toward an interior of the guide groove 11 is disposed on a sidewall of the guide groove 11. The anti-disengagement protrusion 12 corresponds to the anti-disengagement groove 222.

Figure 11:
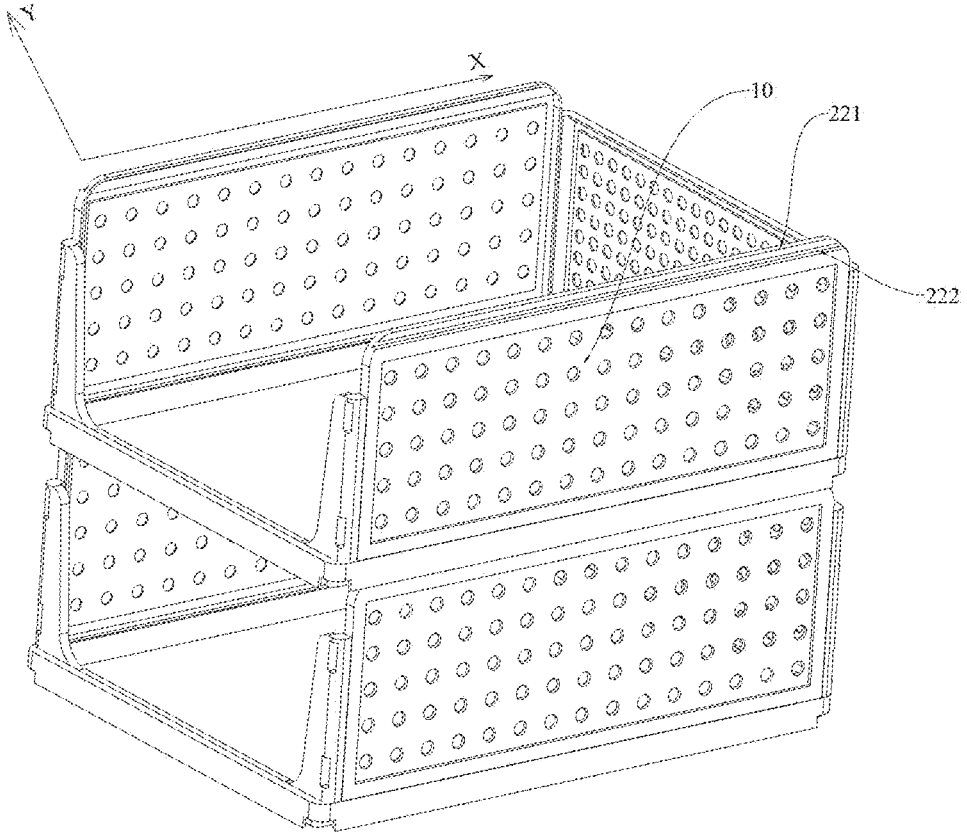
FIG. 11 is a structural view when two boxes are stacked together according to the present disclosure.
Figure 12:
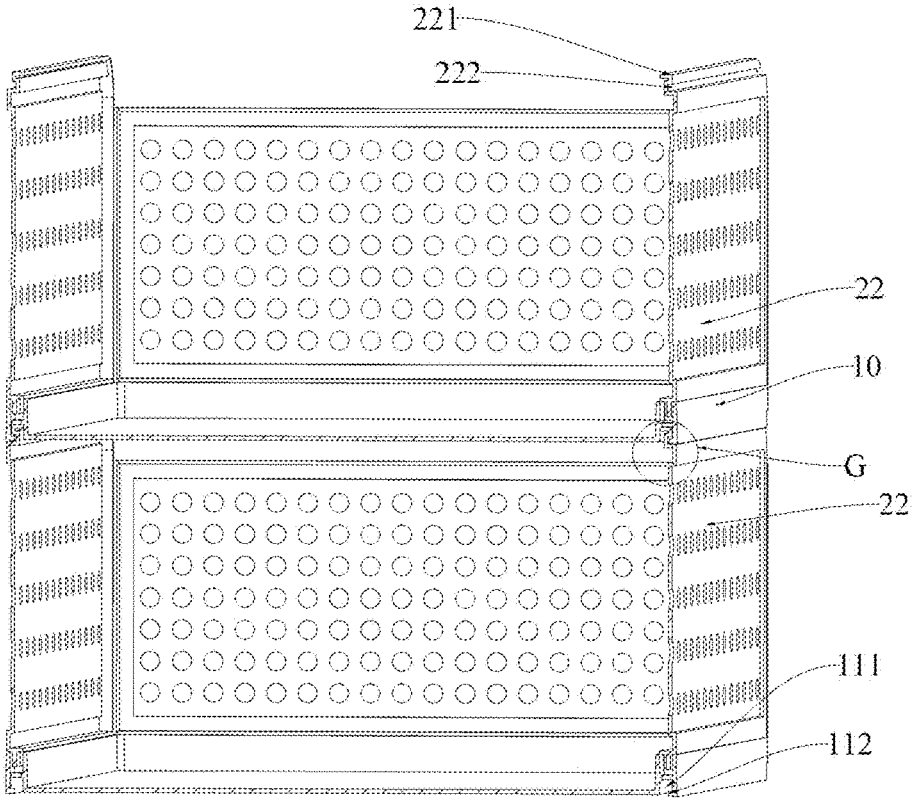
FIG. 12 is a sectional view when two boxes are stacked together according to the present disclosure.
Figure 13:
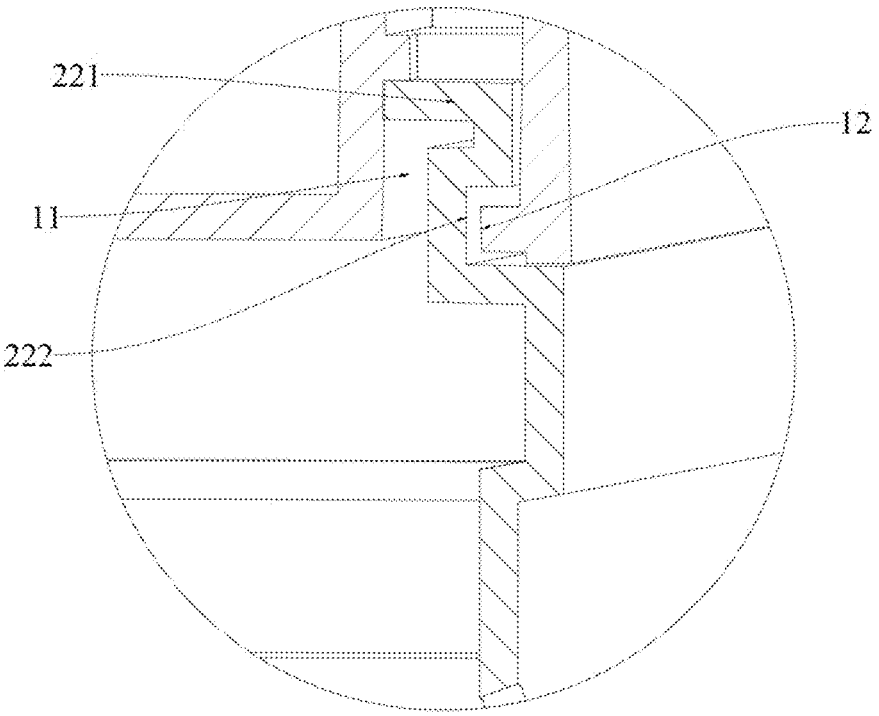
FIG. 13 is an enlarged view of G shown in FIG. 12.

In normal use, as shown in FIG. 11, i.e., when a bottom of the box is placed on the ground (the bottom plate 1 of the box is located on a horizontal plane), for ease of description, it is tentatively defined that a length direction of the side plate 22 of the box is an X-axis direction, a Y-axis direction is perpendicular to the length direction of the side plate 22, and a Z-axis direction is a vertical direction. When a plurality of boxes are stacked for use, and the guide groove 11 matches with the guide protrusion, the guide groove 11 can limit a degree of freedom (DOF) of the guide protrusion 221 in one direction of the horizontal plane (a direction in which the guide protrusion 221 and the guide groove 11 slide relative to each other is the length direction of the side plate 22), and the guide groove 11 can limit a displacement of the guide protrusion 221 in the Y-axis direction. In this case, the upper box can slide out of another box from the X-axis direction and the Z-axis direction, and the sliding fit between the two boxes is unstable. In view of this, the outer side of the guide protrusion 221 is provided with the anti-disengagement groove 222, and the anti-disengagement protrusion 12 is disposed on one sidewall of the guide groove 11. When two boxes are stacked for use, the anti-disengagement protrusion 12 of one box is located in the anti-disengagement groove 222 of the other box. In this case, the anti-disengagement protrusion 12 can slide relative to the anti-disengagement groove 222 in the X-axis direction, and the anti-disengagement groove 222 can limit a displacement of the anti-disengagement protrusion 12 in the Z-axis direction. Therefore, the one box cannot slide out of the other box from the Z-axis direction.

To sum up, in the present disclosure, when two boxes are stacked for use, the two boxes can only slide relatively in the X-axis direction. When the two boxes are stacked, only the guide protrusion 221 of one box is inserted into the guide groove 11 from one end of the guide groove 11 along the X-axis direction (meanwhile, the anti-disengagement protrusion 12 can also be inserted into the anti-disengagement groove 222 from an end of the anti-disengagement groove 222), achieving simple mounting.

In a preferred implementation, the bottom plate 1 is a rectangular plate. That is, the side plates 22 are respectively located on two long sides of the rectangular plate, and the first connecting plate 21 is located on a short side of the rectangular plate.

Furthermore, first insertion opening 13 is formed along a vertical direction in the connecting protrusion 10. First insertion strip 223 is convexly disposed on the bottom of the side plate 22. Two opposite sidewalls of the first insertion opening 13 are each provided with gap 131. Two opposite sides of the first insertion strip 223 are each provided with clamping member 224. The clamping member 224 includes first inclined guide surface 225 and first abutment plane 226 that are sequentially connected. When the first insertion strip 223 is inserted into the first insertion opening 13, the clamping member 224 is located in the gap 131. The first abutment plane 226 of the clamping member 224 abuts against a top of the gap 131.

In the solution of the present disclosure, for ease of transportation, the side plate assembly 2 and the bottom plate 1 are connected in an interlocked manner. During transportation, the side plate assembly 2 and the bottom plate 1 are not assembled. During use, only the side plate assembly 2 is inserted into the connecting protrusion 10. When the side plate 22 is inserted into the connecting protrusion 10, the first insertion strip 223 on the bottom of the side plate 22 is inserted into the first insertion opening 13. Since a width of the first insertion opening 13 is slightly less than a width of the first insertion strip 223, the sidewall of the first insertion opening 13 applies an acting force to the first insertion strip 223 through the first inclined guide surface 225 of the clamping member 224, and the first insertion strip 223 deforms. When the first insertion strip 223 is inserted completely, the insertion strip 223 recovers, the clamping member 224 is located in the gap 131, and the first abutment plane 226 of the clamping member 224 abuts against the top of the gap 131, thereby preventing the first insertion strip 223 from sliding out of the first insertion opening 13, and stably mounting the side plate 22 in the connecting protrusion 10.

Likewise, second insertion opening 14 is further formed along the vertical direction in the connecting protrusion 10. Second insertion strip 211 is convexly disposed on the bottom of the first connecting plate 21. First stop 141 is convexly disposed in the second insertion opening 14. An upper side of the first stop 141 is an inclined surface. An end of the second insertion strip 211 includes second inclined guide surface 212 and second abutment plane 213 that are sequentially connected. The second inclined guide surface 212 has a same inclination direction as the upper side of the first stop 141. When the second insertion strip 211 is inserted into the second insertion opening 14, the second abutment plane 213 abuts against a bottom of the first stop 141.

When the first connecting plate 21 is mounted, the second insertion strip 211 is inserted into the second insertion opening 14, a side of the first stop 141 applies an acting force to the second insertion strip 211 through the second inclined guide surface 212, and the second insertion strip 211 deforms. When the second insertion strip 211 is inserted completely, the second insertion strip 211 recovers, and the second abutment plane 213 of the second insertion strip 211 abuts against the bottom of the first stop 141, thereby preventing the second insertion strip 211 from sliding out of the second insertion opening 14.

In addition, the side plate assembly 2 further includes second connecting plate 23. The second connecting plate 23 is located on another side of the side plate 22. The second connecting plate 23 is configured to connect the two side plates 22. The bottom of the first connecting plate 21 is provided with T-shaped groove 231 and stop groove 232. First T-shaped guide rail 15 and second stop 16 are disposed on a sidewall of the connecting protrusion 10. A side of the second stop 16 is an inclined surface. A bottom of the second stop 16 is a plane. When the second connecting plate 23 is mounted on the connecting protrusion 10, the T-shaped groove 231 is sleeved on the first T-shaped guide rail 15, and a bottom of the second stop 16 abuts against a sidewall of the stop groove 232. The T-shaped groove 231 is configured to limit the first T-shaped guide rail 15 to slide in the horizontal plane. Abutment between the second stop 16 and the stop groove 232 is used to limit a displacement of the second connecting plate 23 in the vertical direction.

In a preferred implementation, opening 233 is formed in the second connecting plate 23 in a penetrating manner. With the opening 233 of the second connecting plate 23, the item in the box can be conveniently taken out from the opening 233. A height of the first connecting plate 21 is less than a height of the side plate 22. When two boxes are stacked for use, a height difference between the first connecting plate 21 and the side plate 22 of the lower box can accommodate the connecting protrusion 10 at the first connecting plate 21 of the upper box, facilitating free sliding between the two boxes.

In addition, two opposite sides of the side plates 22 are each provided with second T-shaped guide rail 227. The second T-shaped guide rail 227 includes connecting strip 228 and snap-fit strip 229. One side of the connecting strip 228 is connected to the side plate 22. Another side of the connecting strip 228 is connected to a middle of the snap-fit strip 229. The connecting strip 228 is perpendicular to the snap-fit strip 229. Two opposite sides of the first connecting plate 21 and the second connecting plate 23 are each provided with elongated hole 24 in a penetration manner. The second T-shaped guide rail 227 is slidably disposed in the elongated hole 24. The connecting strip 228 penetrates through the elongated hole 24. A width of the snap-fit strip 229 is greater than a width of the elongated hole 24. In the above solution, the side plate 22, the first connecting plate 21, and the second connecting plate 23 in the side plate assembly 2 are sequentially connected to form a whole, such that an overall strength of the side plate assembly 2 can be improved, thereby improving the load-bearing capacity of the box.

At last, the present disclosure further provides a box assembly. The box assembly includes a plurality of boxes as described above. The plurality of boxes are sequentially stacked. In two adjacent ones of the plurality of boxes, the guide protrusion 221 of the first box is slidably disposed in the guide groove 11 of the second box. The anti-disengagement protrusion 12 of the second box is located in the anti-disengagement groove 222 of the first box.

It should be understood that the above description of the specific embodiments of the present disclosure is only intended to illustrate the technical route and characteristics of the present disclosure, and its purpose is to enable those skilled in the art to understand the content of the present disclosure and implement it accordingly. However, the present disclosure is not limited to the above-mentioned specific implementations. Any changes or modifications made within the scope of the claims of the present disclosure shall fall within the protection scope of the present disclosure.

The invention claimed is:

1. A stackable and slidable box, comprising: a bottom plate and a side plate assembly, wherein a connecting protrusion is continuously formed along an edge of the bottom plate; guide grooves in pairs are formed in a bottom of the connecting protrusion; and the guide grooves are respectively located on two opposite sides of the bottom plate;

the side plate assembly comprises a first connecting plate and side plates, wherein the side plates are two parallel side plates; the first connecting plate is located on a first side of each of the side plates; two sides of the first connecting plate are respectively connected to the side plates; bottoms of the side plates and a bottom of the first connecting plate are inserted into a top of the connecting protrusion; a guide protrusion is convexly disposed on a top of each of the side plates; and the guide protrusion is located at a same side as the guide groove; and an outer side of the guide protrusion is provided with an anti-disengagement groove; a length direction of the anti-disengagement groove is the same as a length direction of the guide protrusion; an anti-disengagement protrusion protruding toward an interior of the guide groove is disposed on a sidewall of the guide groove; and the anti-disengagement protrusion corresponds to the anti-disengagement groove.

2. The stackable and slidable box according to claim 1, wherein the bottom plate is a rectangular plate.

3. The stackable and slidable box according to claim 1, wherein the side plate assembly further comprises a second connecting plate; the second connecting plate is located on a second side of each of the side plates; the second connecting plate is configured to connect the two parallel side plates; and a bottom of the second connecting plate is provided with a T-shaped groove and a stop groove;

a first T-shaped guide rail and a second stop are disposed on a sidewall of the connecting protrusion; a side surface of the second stop is an inclined surface; and a bottom of the second stop is a plane; and when the second connecting plate is mounted on the connecting protrusion, the T-shaped groove is sleeved on the first T-shaped guide rail, and the bottom of the second stop abuts against a sidewall of the stop groove.

4. The stackable and slidable box according to claim 3, wherein two opposite sides of the side plates are each provided with a second T-shaped guide rail; the second T-shaped guide rail comprises a connecting strip and a snap-fit strip; a first side of the connecting strip is connected to the side plate; a second side of the connecting strip is connected to a middle of the snap-fit strip; and the connecting strip is perpendicular to the snap-fit strip;

two opposite sides of the first connecting plate and the second connecting plate are each provided with an elongated hole in a penetration manner; and the second T-shaped guide rail is slidably disposed in the elongated hole; the connecting strip penetrates through the elongated hole; and a width of the snap-fit strip is greater than a width of the elongated hole.

5. The stackable and slidable box according to claim 3, wherein an opening is formed in the second connecting plate in a penetration manner.

6. The stackable and slidable box according to claim 1, wherein a height of the first connecting plate is less than a height of each of the side plates.

7. The stackable and slidable box according to claim 2, wherein a first insertion opening is formed along a vertical direction in the connecting protrusion; and a first insertion strip is convexly disposed on the bottom of each of the side plates;

two opposite sidewalls of the first insertion opening are each provided with a gap; and two opposite sides of the first insertion strip are each provided with a clamping member; the clamping member comprises a first inclined guide surface and a first abutment plane, wherein the first inclined guide surface and the first abutment plane are sequentially connected; and when the first insertion strip is inserted into the first insertion opening, the clamping member is located in the gap, and the first abutment plane of the clamping member abuts against a top of the gap.

8. The stackable and slidable box according to claim 1, wherein the side plate assembly further comprises a second connecting plate; the second connecting plate is located on a second side of each of the side plates; the second connecting plate is configured to connect the side plates; and a bottom of the second connecting plate is provided with a T-shaped groove and a stop groove;

a first T-shaped guide rail and a second stop are disposed on a sidewall of the connecting protrusion; a side surface of the second stop is an inclined surface; and a bottom of the second stop is a plane; and when the second connecting plate is mounted on the connecting protrusion, the T-shaped groove is sleeved on the first T-shaped guide rail, and the bottom of the second stop abuts against a sidewall of the stop groove.

9. The stackable and slidable box according to claim 2, wherein the side plate assembly further comprises a second connecting plate; the second connecting plate is located on a second side of each of the side plates; the second connecting plate is configured to connect the side plates; and a bottom of the second connecting plate is provided with a T-shaped groove and a stop groove;

a first T-shaped guide rail and a second stop are disposed on a sidewall of the connecting protrusion; a side surface of the second stop is an inclined surface; and a bottom of the second stop is a plane; and when the second connecting plate is mounted on the connecting protrusion, the T-shaped groove is sleeved on the first T-shaped guide rail, and the bottom of the second stop abuts against a sidewall of the stop groove.

10. The stackable and slidable box according to claim 2, wherein a height of the first connecting plate is less than a height of each of the side plates.

11. A stackable and slidable box, comprising: a bottom plate and a side plate assembly, wherein a connecting protrusion is continuously formed along an edge of the bottom plate; guide grooves in pairs are formed in a bottom of the connecting protrusion; and the guide grooves are respectively located on two opposite sides of the bottom plate; and the side plate assembly comprises a first connecting plate and side plates, wherein the side plates are two parallel side plates; the first connecting plate is located on a first side of each of the side plates; two sides of the first connecting plate are respectively connected to the side plates; bottoms of the side plates and a bottom of the first connecting plate are inserted into a top of the connecting protrusion; a guide protrusion is convexly disposed on a top of each of the side plates; and the guide protrusion is located at a same side as the guide groove;

wherein a first insertion opening is formed along a vertical direction in the connecting protrusion; and a first insertion strip is convexly disposed on the bottom of each of the side plates;

two opposite sidewalls of the first insertion opening are each provided with a gap; and two opposite sides of the first insertion strip are each provided with a clamping member; the clamping member comprises a first inclined guide surface and a first abutment plane, wherein the first inclined guide surface and the first abutment plane are sequentially connected; and when the first insertion strip is inserted into the first insertion opening, the clamping member is located in the gap, and the first abutment plane of the clamping member abuts against a top of the gap.

12. The stackable and slidable box according to claim 11, wherein a second insertion opening is further formed along the vertical direction in the connecting protrusion; and a second insertion strip is convexly form on the bottom of the first connecting plate;

a first stop is convexly disposed in the second insertion opening; and an upper side surface of the first stop is an inclined surface; and an end of the second insertion strip comprises a second inclined guide surface and a second abutment plane, wherein the second inclined guide surface and the second abutment plane are sequentially connected; the second inclined guide surface has a same inclination direction as the upper side surface of the first stop; and when the second insertion strip is inserted into the second insertion opening, the second abutment plane abuts against a bottom of the first stop.

13. A box assembly, comprising: a plurality of stackable and slidable boxes, wherein the plurality of stackable and slidable boxes are sequentially stacked; and wherein each of the plurality of stackable and slidable boxes comprises a bottom plate and a side plate assembly;

a connecting protrusion is continuously formed along an edge of the bottom plate; guide grooves in pairs are formed in a bottom of the connecting protrusion; and the guide grooves are respectively located on two opposite sides of the bottom plate;

the side plate assembly comprises a first connecting plate and side plates, wherein the side plates are two parallel side plates; the first connecting plate is located on a first side of each of the side plates; two sides of the first connecting plate are respectively connected to the side plates; bottoms of the side plates and a bottom of the first connecting plate are inserted into a top of the connecting protrusion; a guide protrusion is convexly disposed on a top of each of the side plates; and the guide protrusion is located at a same side as the guide groove; and two adjacent ones of the plurality of stackable and slidable boxes are indicated as a first box and a second box, the guide protrusion of the first box is slidably disposed in the guide groove of the second box; and an anti-disengagement protrusion of the second box is located in an anti-disengagement groove of the first box.

14. The box assembly according to claim 13, wherein an outer side of the guide protrusion is provided with an anti-disengagement groove; a length direction of the anti-disengagement groove is the same as a length direction of the guide protrusion; an anti-disengagement protrusion protruding toward an interior of the guide groove is disposed on a sidewall of the guide groove; and the anti-disengagement protrusion corresponds to the anti-disengagement groove.

15. The box assembly according to claim 14, wherein the bottom plate is a rectangular plate.

16. The box assembly according to claim 13, wherein a first insertion opening is formed along a vertical direction in the connecting protrusion; and a first insertion strip is convexly disposed on the bottom of each of the side plates;

two opposite sidewalls of the first insertion opening are each provided with a gap; and two opposite sides of the first insertion strip are each provided with a clamping member; the clamping member comprises a first inclined guide surface and a first abutment plane, wherein the first inclined guide surface and the first abutment plane are sequentially connected; and when the first insertion strip is inserted into the first insertion opening, the clamping member is located in the gap, and the first abutment plane of the clamping member abuts against a top of the gap.

17. The box assembly according to claim 16, wherein a second insertion opening is further formed along the vertical direction in the connecting protrusion; and a second insertion strip is convexly form on the bottom of the first connecting plate;

a first stop is convexly disposed in the second insertion opening; and an upper side surface of the first stop is an inclined surface; and an end of the second insertion strip comprises a second inclined guide surface and a second abutment plane, wherein the second inclined guide surface and the second abutment plane are sequentially connected; the second inclined guide surface has a same inclination direction as the upper side surface of the first stop; and when the second insertion strip is inserted into the second insertion opening, the second abutment plane abuts against a bottom of the first stop.

* * * * *